US006065997A

United States Patent [19]

Wang

[11] Patent Number: 6,065,997

[45] Date of Patent: May 23, 2000

[54] TERMINAL CONNECTOR STRUCTURE FOR CABLE TELEVISION

[75] Inventor: Shou-Ying Wang, Taipei, Taiwan

[73] Assignee: Jye Dyi C Industrial Co., Ltd., Taipei, Taiwan

[21] Appl. No.: 09/064,949

[22] Filed: Apr. 23, 1998

[30] Foreign Application Priority Data

Mar. 20, 1998 [TW] Taiwan ..... 87204113

[51] Int. Cl.[7] ..... H01R 9/05

[52] U.S. Cl. ..... 439/578

[58] Field of Search ..... 439/675, 578, 439/579, 750, 638, 903, 589

[56] References Cited

U.S. PATENT DOCUMENTS

| | | | |
|---|---|---|---|
| 3,588,783 | 6/1971 | Newman | 439/598 |
| 3,694,793 | 9/1972 | Concelman | 439/358 |
| 4,585,287 | 4/1986 | Ramsey et al. | 439/588 |
| 4,740,170 | 4/1988 | Lee et al. | 439/177 |
| 5,658,171 | 8/1997 | Pauza et al. | 439/675 |
| 5,667,409 | 9/1997 | Wong et al. | 439/654 |
| 5,700,160 | 12/1997 | Lee | 439/578 |

*Primary Examiner*—Michael L. Gellner
*Assistant Examiner*—Barry M. L. Standig
*Attorney, Agent, or Firm*—Varndell & Varndell, PLLC

[57] ABSTRACT

A terminal connector structure for a cable television signal, including an integrally formed housing, a contact member and an insulative tube fitted in an inner through hole of the housing. An arch annular groove is formed on an inner edge of one end of the housing and an engaging flange is formed at the other end of the housing. The insulative tube is disposed with an arch annular flange. The contact member is placed in the insulative tube which is fitted into the housing with the annular flange engaged with the annular groove. Two ends of the housing are formed with plane connecting faces, whereby the tightly connecting area with the connector is increased without a gap so as to effectively isolate interference by various kinds of free waves.

1 Claim, 6 Drawing Sheets

TERMINAL CONNECTOR STRUCTURE FOR CABLE TELEVISION

BACKGROUND OF THE INVENTION

The present invention relates to a terminal connector structure for cable television, and more particularly to a terminal connector capable of effectively isolating interference by various kinds of free waves so as to enhance transmission quality of cable television.

FIG. 1—1 is a sectional view of a conventional terminal connector for cable television signal, which is composed of a housing C, contact plate A and insulative tubes B1, B2 fitted in the housing C. The housing C is formed with a central passage C1. An engaging flange C2 is formed on inner edge of one end of the housing C. The insulative tubes B1, B2 and the contact plate A are inserted into the housing C from the other end thereof. Thereafter, the housing C is twice processed by riveting so as to rivet the thin wall C3. Accordingly, the top end of the insulative tube B1 abuts against the engaging flange C2 of the housing C and the contact plate A is fitted in the other insulative tube B2 and located therein. Also, the inclined thin wall C3 of the housing C is inward riveted to define an insertion socket at the center of the terminal connector.

In the riveting processing of the thin wall C3 of the terminal connector, the arch edge thereof tends to be unplane. Referring to FIGS. 1–2, in an enlarged state, it can be seen that the riveted arch edge of the thin wall C3 is unplane and toothed. Therefore, after the arch edge is screwed with the inner wall D of the terminal nut, fine gap E will be formed on the contacting wall. Accordingly, the transmission cable is subject to interference by external free waves a through the gap E.

In order to eliminate the above problem, an improved terminal connector has been developed as shown in FIG. 2. Such terminal connector is also formed by a housing 3, a contact plate 1 and insulative tubes 2. Such terminal connector is most different from the above conventional one in that the housing 3 is disposed with a cap member 4 formed with a through hole. After the insulative tubes 2 and the contact plate 1 are fitted into the housing 3, the cap member 4 is plugged into the end of the housing instead of the riveting of the thin wall C3. However, after the cap member 4 is plugged into the housing 3, a height drop will exist between the housing and the cap member. In the case that the cap member 4' is not totally plugged in as shown by the phantom line, the cap member needs to be further pressed into the housing. Moreover, it often takes place that the cap member is not planely plugged into the housing and a gap will still exist between the cap member and the housing. Therefore, the external free waves a will still intrude through the gap to cause interference. Therefore, it is necessary to provide a terminal connector which has plane connecting faces at the end for isolating interference by various kinds of free waves.

SUMMARY OF THE INVENTION

It is a primary object of the present invention to provide a terminal connector structure for cable television signal, having plane and enlarged connecting faces at the end for effectively isolating interference by various kinds of free waves.

It is a further object of the present invention to provide the above terminal connector structure which is integrally formed without processing procedure of riveting or adding cap member.

According to the above objects, the terminal connector structure of the present invention includes an integrally formed housing, a contact member and an insulative tube fitted in an inner through hole of the housing. An arch annular groove is formed on inner edge of one end of the housing and an engaging flange is formed at the other end of the housing for locating the contact member and the insulative tubes. Two ends of the housing are formed with plane connecting faces. The insulative tube is disposed with an arch annular flange, whereby the contact member is placed in the insulative tube which is fitted into the housing with the annular flange engaged with the annular groove. Accordingly, the area of the tightly connecting faces of the housing is increased and no gap will exist so as to isolate interference by various kinds of free waves.

The present invention can be best understood through the following description and accompanying drawings, wherein:

BRIEF DESCRIPTION OF THE DRAWINGS

FIGS. 1–2 is an enlarged view of a part of the conventional terminal connector of FIG. 1—1;

FIG. 2 is a sectional assembled view of another conventional terminal connector;

DETAILED DESCRIPTION OF THE PREFERRED EMBODIMENTS

Figure 1:
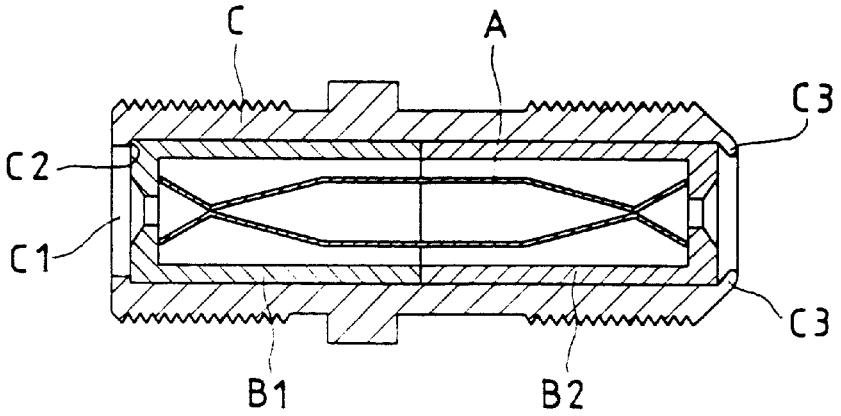
FIG. 1-1 PRIOR ART
FIG. 1—1 is a sectional assembled view of a conventional terminal connector.
Figures 1, 2:
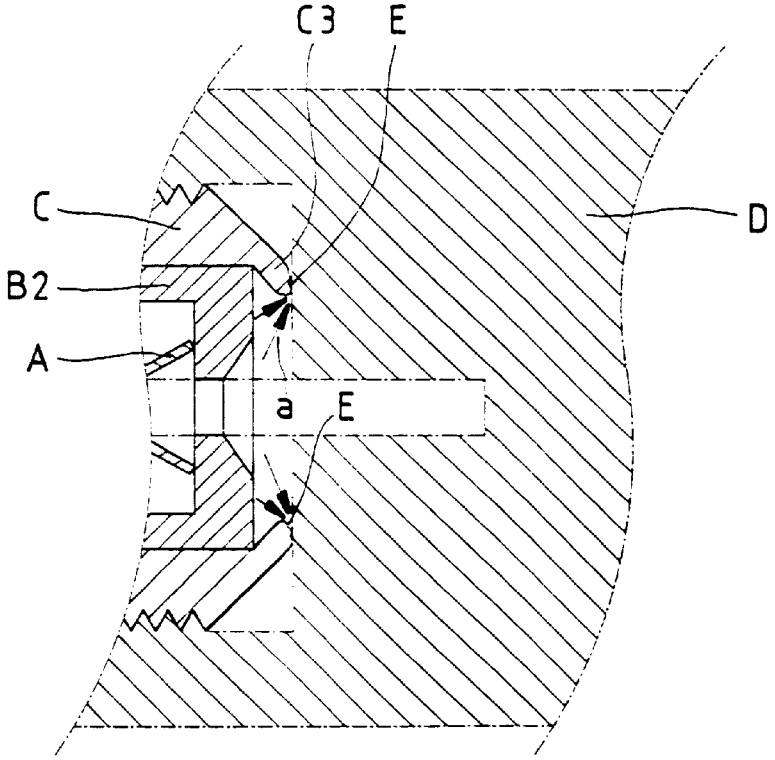
FIG. 1-2 PRIOR ART
Figure 2:
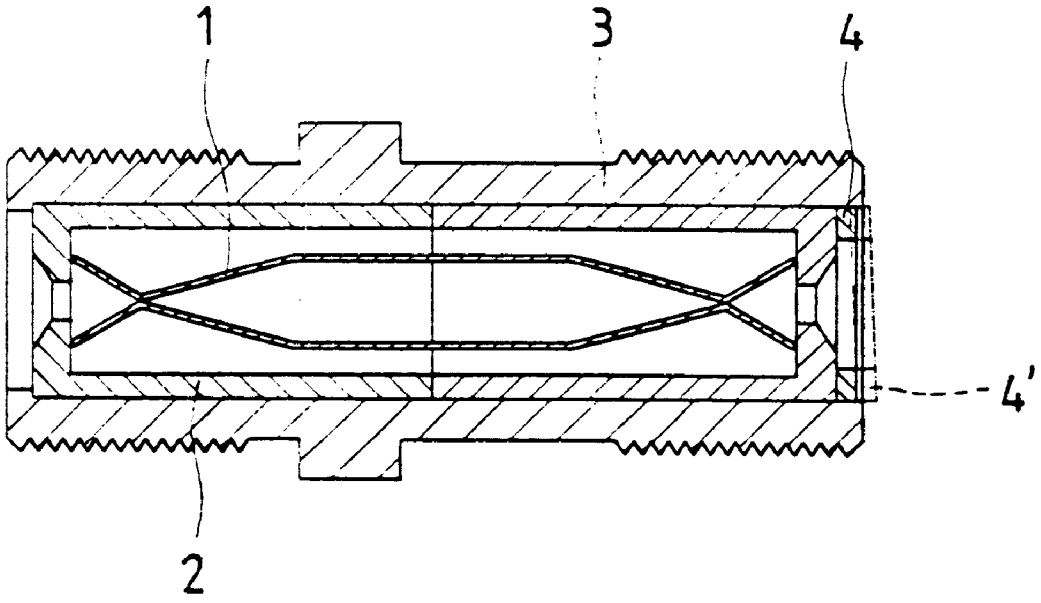
FIG. 2 PRIOR ART
Figure 3:
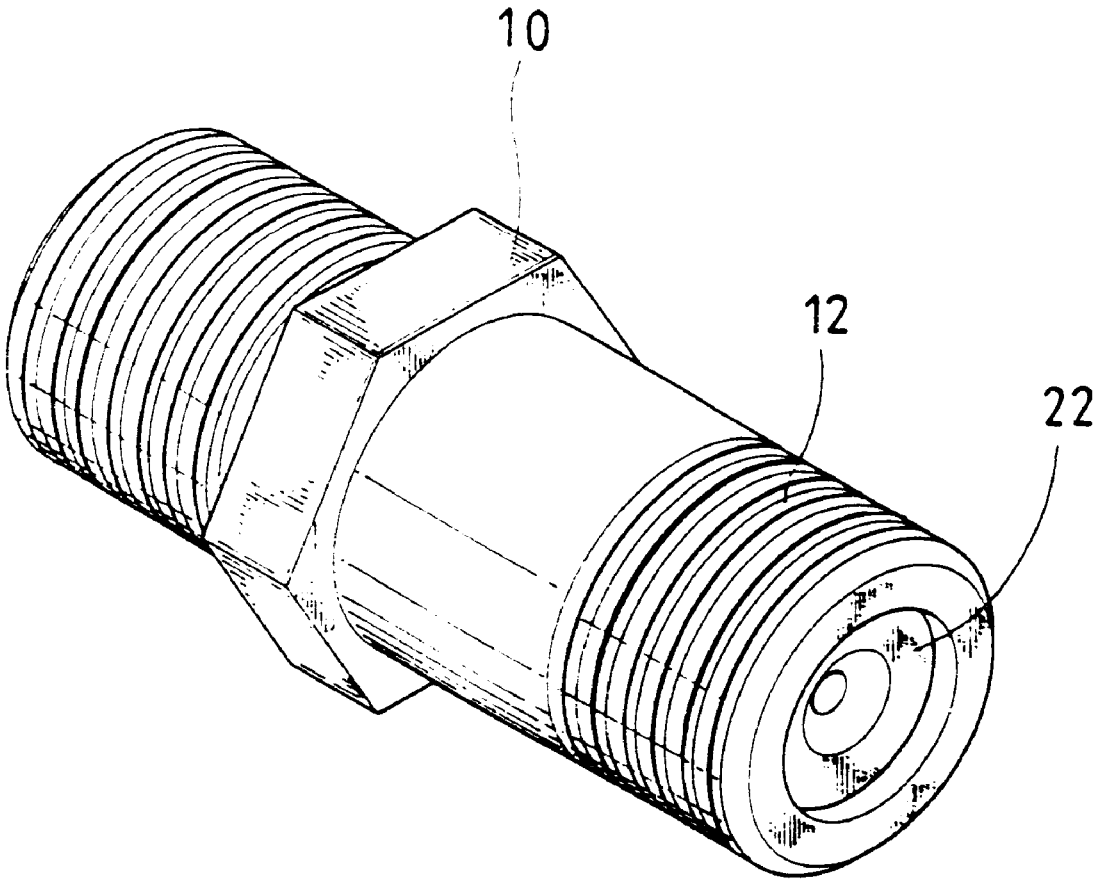
FIG. 3 is a perspective assembled view of the terminal connector of the present invention.
Figure 4:
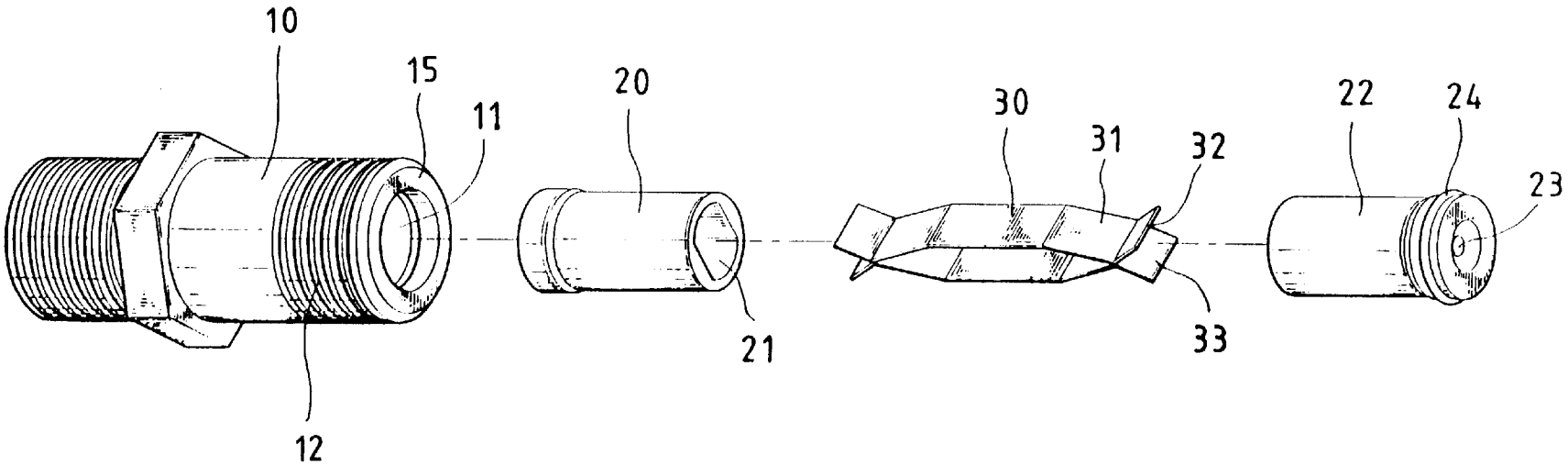
FIG. 4 is a perspective exploded view of the terminal connector of the present invention.

Please refer to FIGS. 3 and 4. The present invention includes an integrally formed terminal housing 10, a contact member 30 and a front and a rear plastic insulative tubes fitted in the housing.

Figure 5:
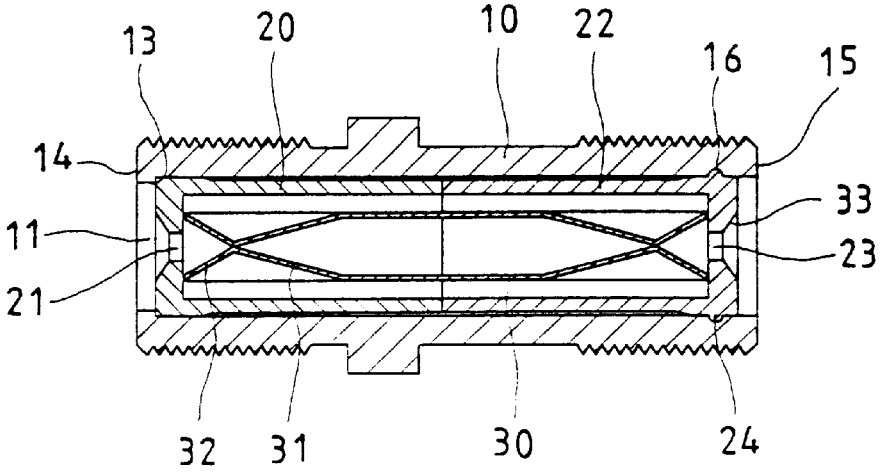
FIG. 5 is a sectional assembled view of the terminal connector of the present invention.

Please refer to FIGS. 4 and 5. The contact member 30 is composed of two metal plates mated with each other. The front end rear ends of the metal plates are formed with downward and upward bent sections 31, 32. After mated with each other, the metal plates form two contact sections and the two upward bent sections 32 define an insertion socket 33. Each of the front and rear insulative tubes 20, 22 has a tube head formed with a small through hole 23. The diameter of the tube head is slightly larger than that of the tube body. The tube body is formed with a relatively large passage 21 for receiving the contact plates 30. An annular arch flange or projection 24 is formed around the tube head of the insulative tube 22.

The housing 10 is formed as a short tube with a certain length. The front and rear ends of the housing are formed with threads 12. The housing is formed with a central passage 11. An engaging flange 13 is formed on inner edge of one end of the housing so that the thread connecting face 14 of this end has larger area. An annular groove 16 is formed on inner edge of the other end of the housing.

The tube head of the front insulative tube 20 is first placed into the passage 11 of the housing 10 to engage with the engaging flange 13 of the housing 10. Then the contact plates 30 are placed into the passages 11, 21 of the housing 10 and the front insulative tube 20. Then the tube tail of the rear insulative tube 22 is placed into the passage 11 of the housing 10 to enclose the contact plates 30 in the passages 21 of the insulative tubes. By means of the resilience of the plastic material, the annular flange or projection 24 of the tube head of the rear insulative tube 22 is engaged in the annular groove 16 of the housing 10, whereby the contact plates 30 and the front and rear insulative tubes 20, 22 are all located in the housing 10 to form an integral body without processing procedure such as pressing or adding a cap. Accordingly, a terminal connector with plane thread connecting faces 14, 15 is achieved.

Figure 6:
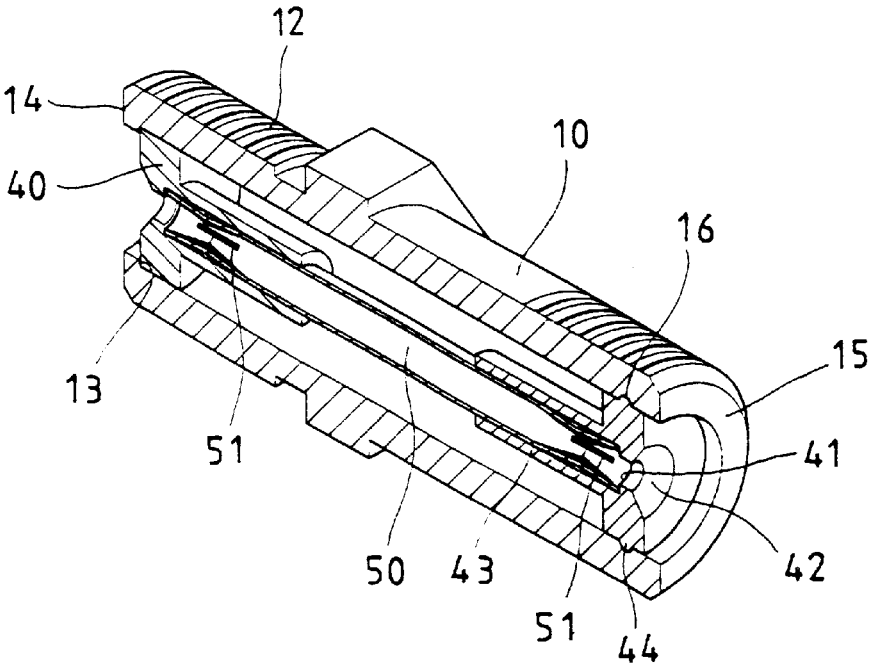
FIG. 6 is a sectional assembled view of another embodiment of the present invention.

FIG. 6 shows another embodiment of the present invention, in which the contact plate 50 is a circular tube two ends of which are formed with multiple axial slits 51. The insulative tube is formed as a T-shaped circular short tube 40 formed with an insertion socket 42 at tube head. The tube tail is formed with a passage 43. An engaging face 41 is disposed between the insertion socket 42 and the passage 43 for engaging with the contact plate 50. One insulative tube 40 is disposed with an arch annular flange or projection 44 at the tube head for engaging with the annular groove 16 of the housing 10.

Figure 7:
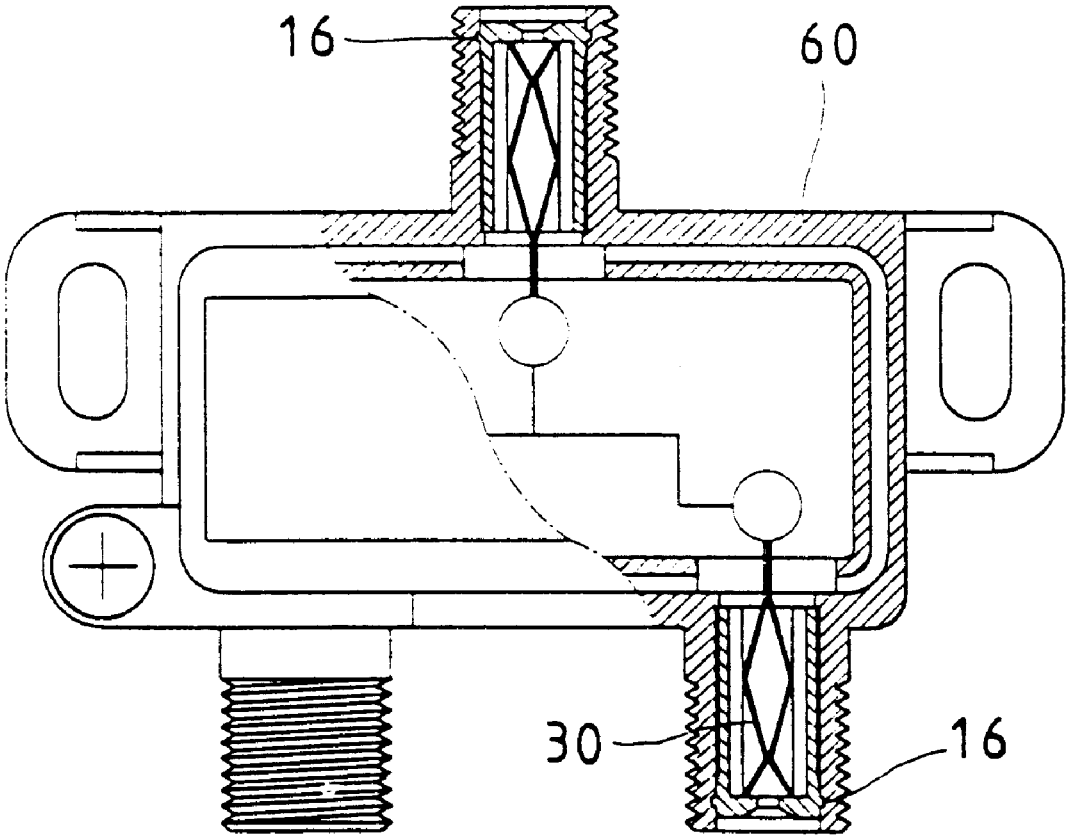
FIG. 7 is a partially sectional view of an application of the present invention.

The present invention is also applicable to a manifold 60 as shown in FIG. 7. In a conventional manifold, an insulative tube with a reverse hook is disposed in a cylindrical hole. The reverse hook has a certain volume so that the usable area in the manifold is reduced. The present invention not only solves the problem of interference by free wave existing the conventional terminal connector, but also increases the usable space of the manifold so as to enhance the transmission quality of cable television.

It should be noted that the above description and accompanying drawings are only used to illustrate some embodiments of the present invention, not intended to limit the scope thereof. Any modification of the embodiments should fall within the scope of the present invention.

What is claimed is:

1. A terminal connector for television cable, comprising an integrally formed housing, a contact member and an insulative tube, said housing including a hollow cylinder and a cylindrical wall formed about said hollow cylinder, said insulative tube fitting within said hollow cylinder of said housing, and said contact member fitting within said insulative tube, said cylindrical wall having first and second ends terminating in flat planar surfaces perpendicular to an axis of said cylindrical wall, said first end of said cylindrical wall having a flange extending inward, said second end of said cylindrical wall including an annular groove, said annular groove being adjacent to said flat planar surface of said second end of said cylindrical wall and having a semicircular cross section, said insulative tube having one end abutting said flange of said cylindrical wall and an annular projection tightly held in said annular groove of said cylindrical wall, said annular projection having a shape matching that of said annular groove; wherein cooperation of said flat planar surfaces of said cylindrical wall, said first end of said insulative tube abutting said flange and said annular groove of said cylindrical wall receiving said annular projection of said insulative tube effectively isolates wave interference.

* * * * *